US008174188B2

(12) United States Patent
Yun et al.

(10) Patent No.: US 8,174,188 B2
(45) Date of Patent: May 8, 2012

(54) ELECTRO-LUMINESCENT DEVICE INCLUDING METAL-INSULATOR TRANSITION LAYER

(75) Inventors: Sun-Jin Yun, Daejeon (KR); JungWook Lim, Daejeon (KR); Hyun-Tak Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 276 days.

(21) Appl. No.: 12/518,107

(22) PCT Filed: Sep. 17, 2007

(86) PCT No.: PCT/KR2007/004464

§ 371 (c)(1),
(2), (4) Date: Jun. 7, 2009

(87) PCT Pub. No.: WO2008/069413

PCT Pub. Date: Jun. 12, 2008

(65) Prior Publication Data

US 2010/0320899 A1 Dec. 23, 2010

(30) Foreign Application Priority Data

Dec. 7, 2006 (KR) ..... 10-2006-0124117

(51) Int. Cl.
*H05B 33/02* (2006.01)

(52) U.S. Cl. ..... 313/509; 313/506; 428/690

(58) Field of Classification Search ..... 313/499, 313/509, 506; 428/690
See application file for complete search history.

(56) References Cited

U.S. PATENT DOCUMENTS

| | | | | |
|---|---|---|---|---|
| 3,731,163 | A * | 5/1973 | Shuskus | 257/324 |
| 5,101,137 | A * | 3/1992 | Kun et al. | 313/509 |
| 5,164,799 | A * | 11/1992 | Uno | 313/509 |
| 5,384,517 | A * | 1/1995 | Uno | 315/169.3 |
| 5,932,964 | A * | 8/1999 | McCann et al. | 313/498 |
| 2006/0255392 | A1 * | 11/2006 | Cho et al. | 257/310 |

FOREIGN PATENT DOCUMENTS

JP 10-319450 12/1998

* cited by examiner

*Primary Examiner* — Nimeshkumar Patel
*Assistant Examiner* — Steven Horikoshi
(74) *Attorney, Agent, or Firm* — Rabin & Berdo, P.C.

(57) ABSTRACT

Provided is an electro-luminescent device (ELD) including a metal-insulator transition (MIT) layer. The ELD includes: a substrate; a EL phosphor layer positioned on the substrate and comprising luminescent center ions generating light; the MIT layer disposed on a surface of the EL phosphor layer and being abruptly changed from an insulator to a metal according to a variation of a voltage; a first insulator adhered to the MIT layer to distribute a voltage applied from an external source; and a second insulator disposed on the other side of the EL phosphor layer.

12 Claims, 4 Drawing Sheets

ELECTRO-LUMINESCENT DEVICE INCLUDING METAL-INSULATOR TRANSITION LAYER

TECHNICAL FIELD

The present invention relates to an electro-luminescent device (ELD), and more particularly, to an ELD including a metal-insulator transition layer.

BACKGROUND ART

Electro-luminescent device (ELD) displays have high durability, long lifetime, wide viewing angle, and environment-resistances. However, the ELD displays have disadvantages in low full-color luminance and high driving voltages. The development of a new blue EL phosphor material and the realization of high luminance white using the new blue EL phosphor material have recently succeeded. Thus, the low full-color luminance of the ELDs has been greatly improved, but the high driving voltage for driving the ELD displays is unsolved. A voltage for driving an alternating current (AC) driving type (AC-) thin film ELD being sold at a market, e.g., an ELD display, is within a range between 150V-250V or above the range.

DISCLOSURE OF INVENTION

Technical Problem

FIGS. 1 and 2 are cross-sectional views of conventional AC-thin film ELDs. Here, an AC-thin film ELD 50 of FIG. 2 is different from an AC-thin film ELD 10 of FIG. 1 in terms of light emission directions.

The AC-thin film ELD 10 of FIG. 1 includes a transparent substrate 12, a transparent first electrode 14, a transparent first insulator 16, EL phosphor layer 18 generating light, a second insulator 20, and an opaque second electrode 22. The light generated by the EL phosphor layer 18 is emitted to an outside through the first insulator 16, the first electrode 14, and the substrate 12 when a voltage (an electric field) is applied between the first and the second electrodes 14 and 22.

The AC-thin film ELD 50 of FIG. 2 includes an opaque substrate 52, an opaque first electrode 54, a first insulator 56, an EL phosphor layer 58 generating light, a transparent second insulator 60, and a transparent second electrode 62. The light generated from the EL phosphor layer 58 is emitted outside through the second insulator 60 and the second electrode 62 when a voltage (an electric field) is applied between the first and the second electrodes 54 and 62. In other words, the AC-thin film ELD 50 emits the light in an opposite direction to a direction to which the AC-thin film ELD device 10 emits the light.

In a conventional AC-thin film ELD (based on FIG. 1), the EL phosphor layer 18 behaves as a capacitor like the first and second insulators 16 and 20 before the EL phosphor layer 18 starts to emit light. Thus, the conventional AC-thin film ELD has an electrical equivalent circuit in which three capacitors are connected to one another in series. Here, an electric field applied to the entire conventional AC-thin film ELD is distributed to each of thin films 16, 18 and 20 according to capacitances determined by dielectric constants and thicknesses of the thin films 16, 18 and 20.

If a portion of the voltage applied to the EL phosphor layer 18 is higher than a threshold electric field (here, the voltage applied to the entire conventional AC-thin film ELD is defined as $V_{th}$), light is generated by the EL phosphor layer 18, and the luminance increases with increasing the electric field, thus the contribution of a resistance component inside the phosphor is increased. In other words, when the electric field applied to the EL phosphor layer 18 is increased to a certain value, an electric field applied to the EL phosphor layer 18 is not increased any more (field clamping). Thus, an increase of luminance according to the increase of electric field slows down. As a result, efficiency of the conventional AC-thin film ELD is greatly reduced. This tendency depends on materials used in an ELD, thicknesses of thin films, and a structure of the ELD. An increase rate (gradient) of the luminance depends on increases of the voltage $V_{th}$ and the voltage applied to the EL phosphor layer 18. The voltage $V_{th}$, the luminance, and the increase rate of the luminance are parameters necessary for practically using an ELD.

As described above, the first and second insulators 16 and 20 make two interfaces with the EL phosphor layer 18 so that the EL phosphor layer 18 is sandwiched between the first and second insulators 16 and 20. Also, an electric field having a predetermined strength or more must be applied to the EL phosphor layer 18 to have the EL phosphor layer 18 emit light. A driving voltage of a thin film ELD is higher than that of other display devices such as OLED and LCD, etc. due to a light emission principle of an ELD as described above.

Technical Solution

The present invention provides a high luminance electro-luminescent device (ELD) driven at a low voltage.

According to an aspect of the present invention, there is provided an ELD including a metal-insulator transition (MIT) layer, including: a substrate; a EL phosphor layer positioned on the substrate and including EL phosphor layer containing luminescent center ions generating light; the MIT layer disposed on one side of the EL phosphor layer and being abruptly changed from an insulator into a metal according to a variation of a voltage; a first insulator adhered to the MIT layer to distribute a voltage applied from an external source; and a second insulator disposed on the other side of the EL phosphor layer.

According to another aspect of the present invention, there is provided a n ELD including a MIT layer, including: a substrate; a EL phosphor layer positioned on the substrate and including EL phosphor layer containing luminescent center ions; a first MIT layer disposed on one side of the EL phosphor layer and being abruptly changed from an insulator into a metal according to a variation of a voltage; a first insulator adhered to the first MIT layer to distribute a voltage applied from an external source; a second MIT layer disposed on the other side of the EL phosphor layer and being abruptly changed from an insulator into a metal according to the variation of the voltage; and a second insulator adhered to the second MIT layer to distribute the voltage applied from the external source.

Advantageous Effects

In an ELD including an MIT layer according to the present invention, the MIT layer showing an abrupt MIT phenomenon is inserted between a EL phosphor layer and an insulator to remarkably reduce a threshold voltage $V_{th}$ of the ELD. Luminance and an increasing rate of the luminance can be greatly increased. In other words, when the MIT layer shows an insulation property, the MIT layer can operate as an insulator. If an electric voltage applied to the MIT layer is greater than a voltage $V_{MIT}$, the MIT layer can abruptly transit into a metal state. Furthermore, as soon as an electric field applied to the EL phosphor layer is abruptly increased, a large number of electrons can be accelerated into the EL phosphor layer.

Best Mode

Figure 1:
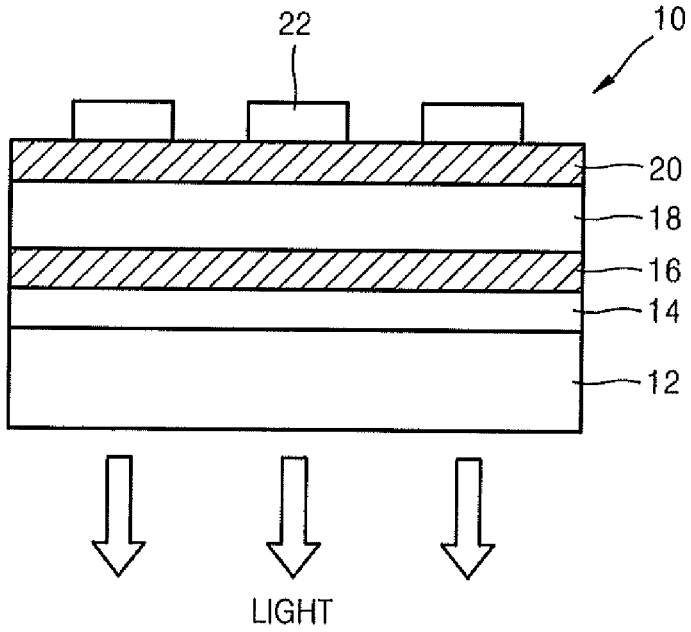
FIG. 1 (PRIOR ART)
FIGS. 1 and 2 are cross-sectional views of a conventional AC-thin film electro-luminescent device (ELD)
Figure 2:
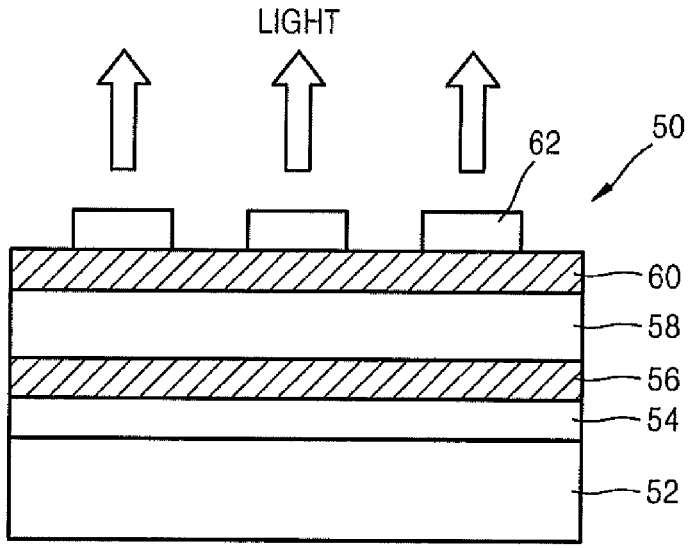
FIG. 2 (PRIOR ART)

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals in the drawings denote like elements, and thus their description will be omitted.

Embodiments of the present invention provide a thin film ELD including a thin film showing an abrupt metal-insulator transition (MIT) phenomenon occurring when an electric field higher than its MIT threshold voltage is applied to the MIT layer positioned between an EL phosphor layer and an insulator. Before an MIT phenomenon occurs, an MIT layer shares an electric field with the EL phosphor layer and the insulator because the MIT layer is still an insulator. If the MIT layer reaches a certain electric field $V_{MIT}$, the MIT layer abruptly shows a metal characteristic so as to make the EL phosphor layer abruptly take higher electric field. Furthermore, the metallic MIT layer provides more electrons to EL phosphor layer. As a result, if the MIT layer is inserted, light starts to be emitted at a low driving voltage and luminance becomes higher with increasing the voltage because the insulating layer turns to a metallic layer. Hereinafter, $V_{MIT}$ denotes a voltage at which the MIT layer is changed from an insulator to a metal, and $V_{th}$ denotes a voltage at which the EL phosphor layer emits light.

A EL phosphor material of the ELD includes luminescent center ions such as Mn, Eu, Pb, Pr, Tb, Tm, Tu, Ce, Nd, Pm, Sm, Gd, Dy, Ho, Er, Yb, Lu, Cu, Ag, and Co ions added to ZnS, SrS, CaS, CaSrS, SrGas, BaAlS, etc. The luminescent center ions are excited by impact of electrons accelerated by an electric field or receive energy due to similar mechanisms to be excited on a higher energy level and then stabilized to a ground state by emitting a light. The luminescent center ions emit light having a wavelength corresponding to an energy difference between excited and ground states.

An MIT material is a material that shows abrupt transition from an insulator to a metal when an electric field, pressure, and/or heat higher than critical values are applied. The MIT layer may be formed of one of a p-type semiconductor, an n-type semiconductor, and a dielectric material. For example, the MIT layer may be formed of an organic or inorganic semiconductor having low-density holes or low-density electrons. Alternatively, the MIT layer may be formed of an organic or inorganic dielectric material. The MIT layer may further include at least one of oxygen, carbon, a III-V group or II-VI group semiconductor element, a transition metal element, a rare-earth element, and lanthanum-based elements, as needed.

Hereinafter, an operation principle of an ELD of the present invention will be described. A characteristic of the ELD obtained before a MIT layer is inserted is evaluated to compare the present invention with the prior art. Since an insulator and an EL phosphor layer prior to light emission show capacitor characteristics, an electric filed is dividedly applied to the insulator and the EL phosphor layer. In a case of a direct current (DC) driving type ELD (DC-ELD) having no insulator, most of an electric field is applied to an EL phosphor layer. In order to emit light, electrons must be accelerated in the EL phosphor layer, and energy must be transmitted to luminescent center ions. Thus, a predetermined strength of energy is required to emit light, and an electric filed applied to the EL phosphor layer must be 1 MV/cm or higher.

If an MIT layer of the present invention is inserted into the above-described structure, the MIT layer may abruptly transit from an insulator to a metal at a predetermined voltage or higher. The insertion of MIT layer can enhance the increase rate of luminance. Also, reflectivity is increased due to the injection of a lot of electrons from the MIT layer transited to the metal. Thus, luminance is increased. The embodiments of the present invention will be described based on insertion and arrangement positions of a MIT layer. If necessary, the embodiments may be described from various viewpoints within a scope of the present invention.

Figure 3:
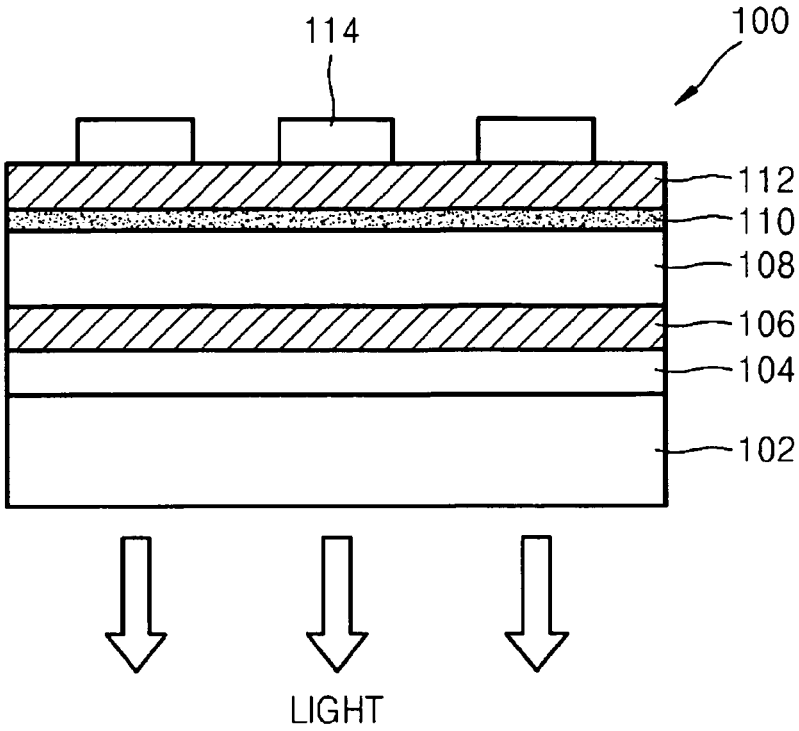
FIGS. 3 and 4 are cross-sectional views of ELDs according to embodiments of the present invention.
Figure 4:
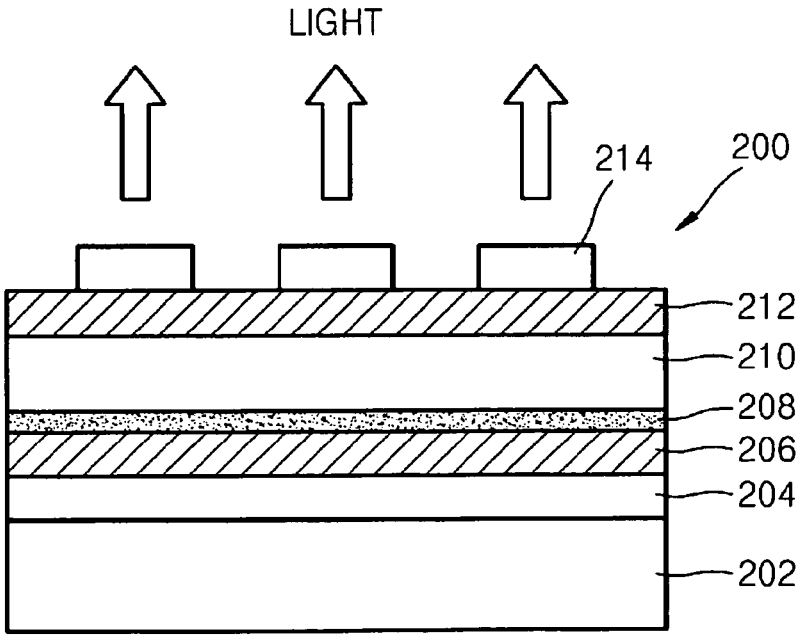

FIGS. 3 and 4 are cross-sectional views of ELDs according to embodiments of the present invention. Here, an ELD 200 of FIG. 4 is different from an ELD 100 in terms of light emission directions.

The ELD 200 of FIG. 3 has a stack structure of a transparent substrate 102, a transparent second electrode 104, a transparent second insulator 106, a EL phosphor layer 108 generating light, a MIT layer 110, a first insulator 112, and opaque first electrodes 114. If a voltage is applied to the first and second electrodes 114 and 104 and the voltage applied to the MIT layer 108 is higher than the voltage $V_{MIT}$ described above, the MIT layer 108 transits into a metal state.

Since the MIT layer 110 operates as an insulator before MIT occurs, thicknesses of the first and second insulators 112 and 106 are thinner than in a general ELD having no MIT layer. If a voltage higher than or equal to the voltage $V_{MIT}$ is applied the ELD 100, the MIT layer 110 abruptly transits from an insulator to a metal. Thus, a portion of the voltage dividedly applied to the EL phosphor layer 108 exceeds a threshold voltage $V_p$. As a result, luminance is suddenly increased, and electrons of the MIT layer 110 adjacent to the EL phosphor layer 108 are supplied to the EL phosphor layer 108. Therefore, in comparison with the general ELD having no MIT layer, higher luminance can be obtained.

A thickness of a MIT layer must be determined according to the following criteria. A voltage applied to an entire ELD is dividedly applied to insulators, an EL phosphor layer, and an MIT layer in an insulation state. When the voltage applied to the MIT layer is $V_{MIT}$, the voltage applied to the EL phosphor layer is lower than a threshold voltage $V_p$ at which the EL phosphor layer starts to emit light. When the voltage applied to MIT layer is higher than $V_{MIT}$ and the MIT layer turns into a metallic state, the voltage applied to the EL phosphor is increased since an electric field can not be maintained any more in the metallic MIT layer. At that time, the voltage applied to the EL phosphor layer is abruptly increased, and the voltage across the EL phosphor layer is higher than the threshold voltage $V_p$. Thus, the EL phosphor layer emits light immediately after MIT occurs.

The EL phosphor layer 108 emits light at a lower voltage than a threshold voltage $V_{th}$ in the general ELD having no MIT layer as described above. The light from the EL phosphor layer 108 is emitted outside through the second insulator 106, the second electrode 104, and the substrate 102. The ELD 100 has a front surface light emitting structure.

The ELD 200 of FIG. 4 has a stack structure of an opaque substrate 202, an opaque first electrode 204, a first insulator 206, an MIT layer 208, an EL phosphor layer 210 generating light, a transparent second insulator 212, and transparent second electrodes 214. When a voltage is applied to the first and second electrodes 204 and 214, and the voltage dividedly applied to the MIT layer 208 is greater than the voltage $V_{MIT}$ described above, the MIT layer 208 is changed from insulator to a metal state.

Electrons generated in the MIT layer 208 in the metal state are injected into the EL phosphor layer 210 to transfer sufficient energy for light emission to luminescent center ions. Thus, the EL phosphor layer 208 emits light at a lower voltage than a threshold voltage $V_{th}$ of a conventional ELD. The light generated from the EL phosphor layer 208 is emitted to an outside through the second insulator 212 and the second electrode 214. The ELD 200 has an inverted light emission structure.

Since the MIT layers 110 and 208 are changed into metals and then have high reflectance, the MIT layers 110 and 208 are respectively disposed in positions opposite to light emission directions of the EL phosphor layers 108 and 210, i.e., positions in which luminance of emitted light is increased. If a portion of an MIT layer is modified into a structure transmitting light, and a substrate and electrodes are transparent thin films, a transparent ELD viewed in both directions may be manufactured. The transparent ELD has a bi-directional observable structure.

In the above-described embodiments of the present invention, an MIT layer can be adhered onto a surface of an EL phosphor layer to lower a driving voltage of an ELD and increase luminance of the ELD. Also, since a voltage $V_{MIT}$ depends on a material and a structure or thickness of the MIT layer, the driving voltage of the ELD can be adjusted using the MIT layer.

Mode for Invention

Figure 5:
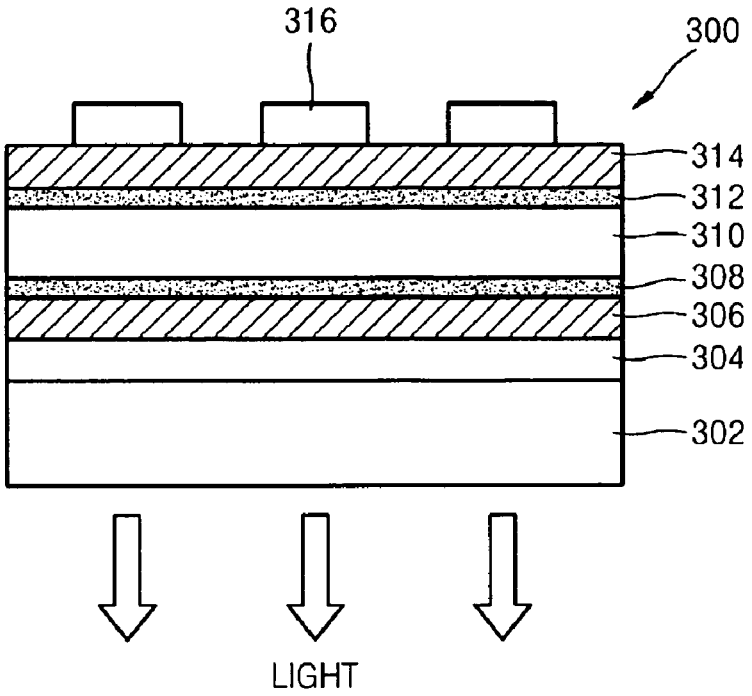
FIGS. 5 and 6 are cross-sectional views of ELDs according to embodiments of the present invention.
Figure 6:
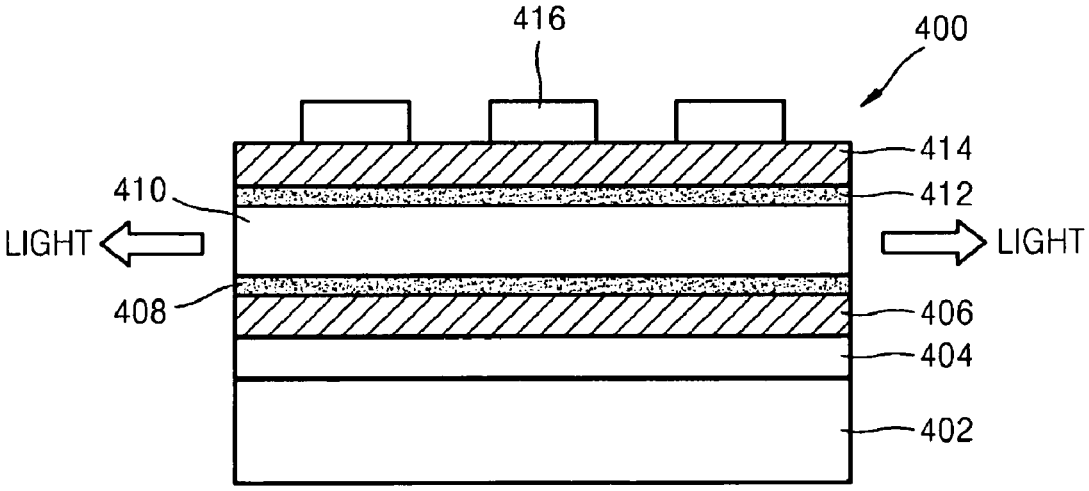

FIGS. 5 and 6 are cross-sectional views of ELDs according to embodiments of the present invention. Here, an ELD 300 of FIG. 5 is different from an ELD 400 of FIG. 6 in terms of light emission directions.

Referring to FIG. 5, the ELD 300 has a stack structure of a transparent substrate 302, a transparent first electrode 304, a transparent first insulator 306, a first MIT layer 308, a EL phosphor layer 310 generating light, a second MIT layer 312, a second insulator 314, and opaque second electrodes 316. When a voltage is applied to the first and second electrodes 304 and 316, and portions of the voltage applied to the first and second MIT layers 308 and 312 are greater than the voltage $V_{MIT}$ described above, the first and second MIT layers 308 and 312 are changed into metal states.

In more detail, if a voltage higher than or equal to the voltage $V_{MIT}$ is dividedly applied to the first and second MIT layers 308 and 312, the first and second MIT layers 308 and 312 are abruptly changed from insulators into metals. Thus, the voltage dividedly applied to the EL phosphor layer 308 exceeds a threshold voltage $V_p$, and thus luminance is abruptly increased. As a result, electrons generated from the first and second MIT layers 308 and 312 in the metal states are injected into the EL phosphor layer 310 along a direction to which an electric field is applied, thereby transferring sufficient energy for light emission to luminescent center ions. Accordingly, the EL phosphor layer 310 emits light at a lower voltage than a threshold voltage $V_{th}$ of the voltage applied to the first and second electrodes 304 and 316. A thickness of an MIT layer is determined according to the following criteria. A voltage applied to an entire ELD is dividedly applied to insulators, an EL phosphor layer, and two MIT layers in insulation states. When the voltage applied to the two MIT layers are each $V_{MIT}$, the voltage applied to the EL phosphor layer is lower than a threshold voltage $V_p$ at which the EL phosphor layer starts to emit light. When the voltages applied to the MIT layers are higher than $V_{MIT}$, respectively, and the MIT layers turn into metallic states, the voltage applied to the EL phosphor layer is increased since an electric filed can not be maintained any more in each of the metallic MIT layers. At that time, the voltage applied to the EL phosphor layer is abruptly increased and the voltage across the EL phosphor layer is higher than the threshold voltage $V_p$. Thus, the EL phosphor layer emits light immediately after MIT occurs.

The light emitted from the EL phosphor layer 310 is emitted outside through the first MIT layer 308, the first insulator 306, the second electrode 304, and the substrate 302. Here, the first MIT layer 308 may have a structure transmitting light, e.g., have a thin thickness. The ELD 300 can supply a larger amount of current to an EL phosphor layer 310 than the ELDs 100 and 200 and thus have a lower driving voltage than the ELDs 100 and 200.

The ELD 400 of FIG. 6 has a stack structure of an opaque substrate 402, an opaque first electrode 404, a first insulator 406, a first MIT layer 408, a EL phosphor layer 410 generating light, a second MIT layer 412, a second insulator 414, and opaque second electrodes 416. The opaque first and second electrodes 404 and 416 may be formed of metals having high reflectance. If a voltage is applied to the first and second electrodes 404 and 416 to be dividedly applied to the first and second MIT layers 408 and 412 and is greater than the voltage $V_{MIT}$ described above, the first and second MIT layers 408 and 412 are changed into metal states.

Currents generated by the first and second MIT layers 408 and 412 in the metal states are injected into the EL phosphor layer 410 to transfer sufficient energy necessary for light emission to luminescent center ions. Thus, the EL phosphor layer 410 emits light at a lower voltage than a threshold voltage $V_{th}$ of the voltage applied to the first and second electrodes 404 and 416 without the first and second MIT layers 408 and 412. The light emitted from the EL phosphor layer 408 is limited by the first and second MIT layers 408 and 412 and the opaque electrodes 404 and 416. In the ELD 400, all thin films can be formed of opaque layers compared to the ELDs 100 and 200, and a light emission direction should be changed and high luminance light could be emitted toward the side of the EL phosphor layer 410 as shown in FIG. 6.

Figure 7:
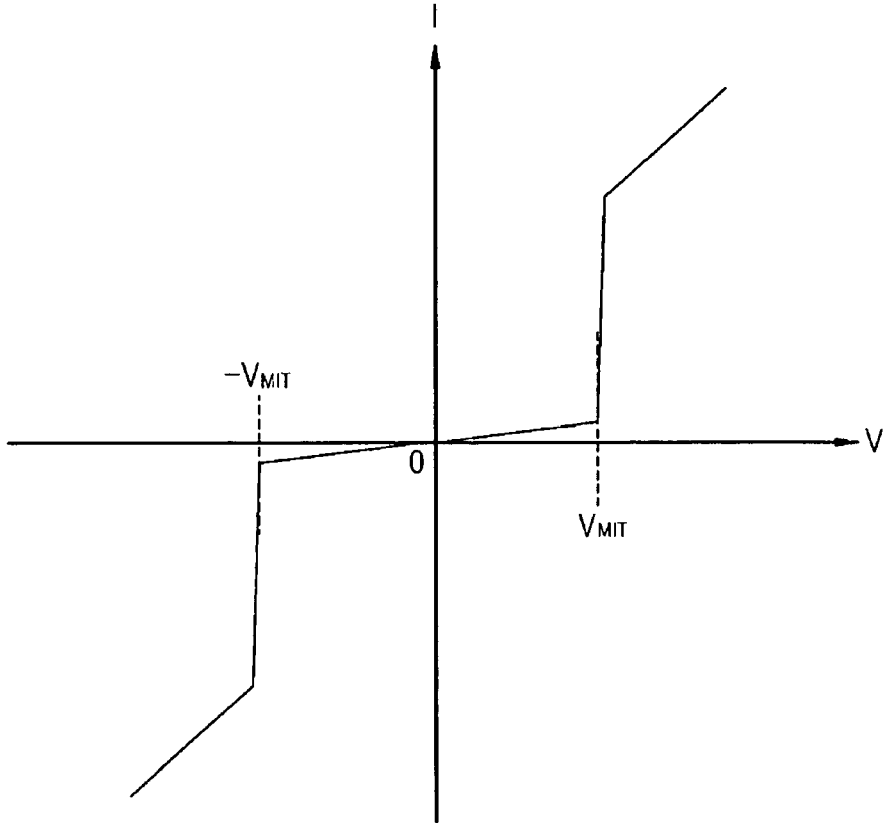
FIG. 7 is a graph illustrating a relationship between a current (I) and a voltage (V) of a metal-insulator transition (MIT) layer used in the embodiments of the present invention.

FIG. 7 is a graph illustrating an I (current)-V (voltage) relationship in case of a MIT layer used in the embodiments of the present invention.

The ELD 100 of FIG. 3 will be exemplarily described herein. Referring to FIG. 7, if an MIT layer is inserted in the middle of a EL phosphor layer and an insulator, the MIT layer operates as an insulator at a voltage $V_{MIT}$ or lower. Thus, an electric field having a certain strength is dividedly applied to the MIT layer and the insulator according to their thickness and dielectric constant. Therefore, each thickness of first and second insulators of the present invention is thinner than in a general ELD. A thickness of the MIT layer must be determined according to the following criteria. A voltage applied to an entire ELD is dividedly applied to insulators, a EL phosphor layer, and an MIT layer in an insulation state. Also, when the voltage applied to the MIT layer is $V_{MIT}$, the voltage applied to the EL phosphor layer is lower than a threshold voltage $V_p$ at which the EL phosphor layer emits light. When the applied voltage increases more to have the voltage applied to MIT layer be higher than $V_{MIT}$ and the MIT layer turn to be in a metallic state, an electric field is not maintained any more in the metallic MIT layer.

As a result, when the voltage applied to the EL phosphor layer is abruptly increased, the increased voltage becomes higher than the threshold voltage $V_p$. Accordingly, the EL phosphor layer abruptly emits light immediately after MIT occurs. As described above, the thickness of the MIT layer is calculated in consideration of the first and second insulators and the thickness and a dielectric constant of the MIT layer in the insulation state.

Figure 8:
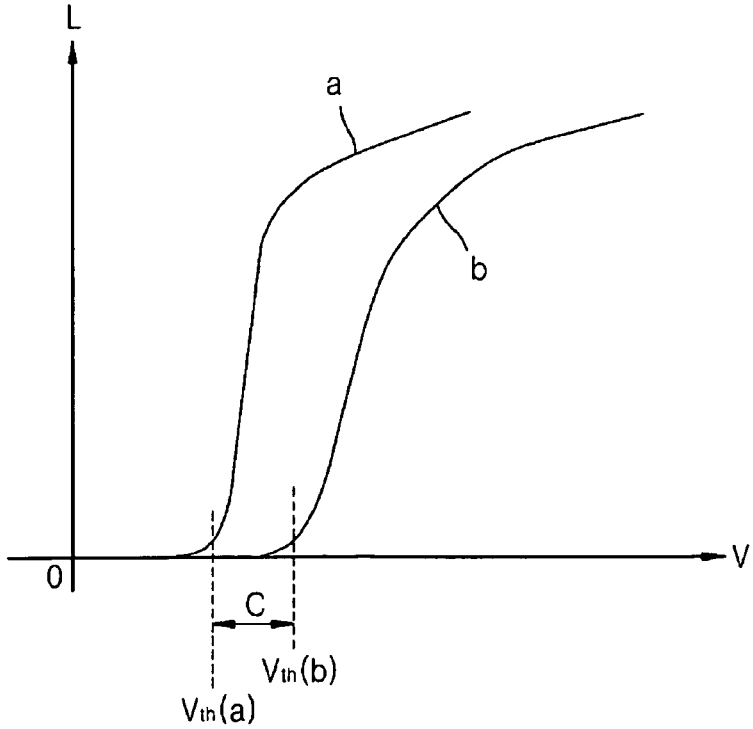
FIG. 8 is a graph comparing a relationship a between luminance (L) and a voltage (V) in an ELD of the present invention with a relationship between L and V in a conventional ELD.

FIG. 8 is a graph comparing a relationship (a) between luminance L and a voltage V in an ELD of the present invention with a relationship (b) between luminance L and a voltage V in a conventional ELD. Referring to FIG. 8, insertion of an MIT layer remarkably reduces the driving voltage applied to an entire ELD to obtain a sufficient luminance. In other words, a threshold voltage $V_{th}$ (a) of an ELD of the present invention is decreased by c compared to a threshold voltage $V_{th}$ (b) of a conventional ELD. Also, an increasing rate (gradient) of luminance of the ELD of the present invention is abruptly increased with an increase of a voltage compared to the conventional ELD. In other words, compared to the conventional ELD, the luminance of the ELD of the present invention can be early saturated.

Industrial Applicability

The present invention provides a high luminance electroluminescent device (ELD) driven at a low voltage.

The invention claimed is:

1. An ELD (electro-luminescent device) comprising an MIT (metal-insulator transition) layer, comprising:

a substrate;

a EL phosphor layer positioned on the substrate and comprising luminescent center ions generating light;

the MIT layer disposed on one side of the EL phosphor layer and being abruptly changed from an insulator to a metal according to a variation of a voltage;

a first insulator adhered to the MIT layer; and a second insulator disposed on the other side of the EL phosphor layer, wherein:

a first voltage applied to the entire ELD, is dividedly applied to the first insulator, the second insulator, the MIT layer, and the EL phosphor layer;

the first voltage applied to the entire ELD determines the abrupt change of the MIT layer to the metal, such that the abrupt change of the MIT layer to the metal occurs when a portion of the first voltage applied to the MIT layer is the same as or greater than $V_{MIT}$ which is an MIT threshold voltage at which the MIT layer is changed from an insulator to a metal; and a thickness of the MIT layer is determined so that when the portion of the first voltage applied to the MIT layer is equal to or lower than $V_{MIT}$, the voltage applied to the EL phosphor layer is lower than a threshold voltage $V_p$ at which the EL phosphor layer emits light, and when the portion of the first voltage applied to MIT layer is higher than $V_{MIT}$ so that the MIT layer turns into a metal state, the electric field applied to the EL phosphor layer is increased to a voltage higher than the threshold voltage $V_p$.

2. The ELD of claim 1, further comprising:

a first electrode adhered to the first insulator to be supplied with the voltage applied from an external source; and a second electrode adhered to the second insulator to be supplied with the voltage applied from the external source, wherein the first voltage is a voltage applied between the first and second electrodes.

3. The ELD of claim 1, wherein light is emitted toward the substrate in a direction perpendicular to the EL phosphor layer.

4. The ELD of claim 2, wherein light is emitted toward the second electrode in a direction perpendicular to the EL phosphor layer.

5. The ELD of claim 1, wherein the MIT layer determines a voltage at which the EL phosphor layer emits light.

6. The ELD of claim 1, wherein the MIT layer is formed of one of a p-type semiconductor, an n-type semiconductor, and a dielectric material.

7. The ELD of claim 6, wherein the MIT layer includes at least one of oxygen, carbon, a III-V group or II-VI group semiconductor element, a transition metal element, a rare-earth element, and lanthanum-based elements.

8. The ELD of claim 6, wherein the MIT layer is formed of an organic or inorganic material.

9. An ELD (electro-luminescent device) comprising a MIT (metal-insulator transition) layer, comprising:

a substrate;

a EL phosphor layer positioned on the substrate and comprising luminescent center ions;

a first MIT layer disposed on one side of the EL phosphor layer and abruptly transiting from an insulator into a metal according to a variation of a voltage;

a first insulator adhered to the first MIT layer;

a second MIT layer disposed on the other side of the EL phosphor layer and abruptly transiting from an insulator into a metal according to the variation of the voltage; and a second insulator adhered to the second MIT layer, wherein:

a first voltage applied to the entire ELD, is dividedly applied to the first insulator, the second insulator, the first MIT layer, the second MIT layer and the EL phosphor layer;

the first voltage applied to the entire ELD determines the abrupt change of the MIT layer to the metal, such that the abrupt change of the MIT layer to the metal occurs when each portion of the first voltage respectively applied to the first and second MIT layers is the same as or greater than $V_{MIT}$ which is an MIT threshold voltage at which each of the first and second MIT layers is changed from an insulator to a metal; and each thickness of the first and second MIT layers is determined so that when each portion of the first voltage respectively applied to the first and second MIT layers is equal to or lower than $V_{MIT}$, the voltage applied to the EL phosphor layer is lower than a threshold voltage $V_p$ at which the EL phosphor layer emits light, and when each portion of the first voltage respectively applied to the first and second MIT layers is higher than $V_{MIT}$ so that the first and second MIT layers turn into a metal state, the electric field applied to the EL phosphor layer is increased to a voltage higher than the threshold voltage $V_p$.

10. The ELD of claim 9, further comprising:

a first electrode adhered to the first insulator to be supplied with the voltage applied from an external source; and a second electrode adhered to the second insulator to be supplied with the voltage applied from the external source, wherein the first voltage is a voltage applied between the first and second electrodes.

11. The ELD of claim 9, wherein light is emitted in a direction parallel with the EL phosphor layer.

12. The ELD of claim 1, wherein the entire upper surface of the MIT layer is covered with the first insulator and the entire lower surface of the MIT layer is covered with the EL phosphor layer.

* * * * *